US005872440A

United States Patent [19]

Brabant et al.

[11] Patent Number: 5,872,440

[45] Date of Patent: Feb. 16, 1999

[54] OSCILLATING MECHANICAL DEVICE, IN PARTICULAR A CARD WEB COMB FOR A TEXTILE MACHINE, IN WHICH OSCILLATIONS ARE SUSTAINED BY MEANS OF A SINGLE-PHASE INDUCTION MOTOR

[75] Inventors: Marc Brabant; Xavier Catry, both of Hem; Didier Deldique, Tourcoing, all of France

[73] Assignee: Thibeau (SA), Tourcoing, France

[21] Appl. No.: 721,107

[22] Filed: Sep. 26, 1996

[30] Foreign Application Priority Data

Sep. 25, 1995 [FR] France ..... 95 11629

[51] Int. Cl.[6] ..... H02K 41/06

[52] U.S. Cl. ..... 218/686; 318/127; 318/608

[58] Field of Search ..... 318/800–807, 318/686, 127, 687, 671, 126, 128, 608, 809, 701, 729; 310/51, 90; 57/81; 19/0.25, 225; 242/18.1, 43 R

[56] References Cited

U.S. PATENT DOCUMENTS

| | | | |
|---|---|---|---|
| 3,750,235 | 8/1973 | Wise | 19/105 |
| 4,122,657 | 10/1978 | Felix | 57/81 |
| 4,181,877 | 1/1980 | Gemp | 318/345 R |
| 4,249,120 | 2/1981 | Earle | 318/729 |
| 4,310,791 | 1/1982 | Akamatsu | 318/800 |
| 4,345,721 | 8/1982 | Derail | 242/18.1 |
| 5,111,374 | 5/1992 | Lai et al. | 363/37 |
| 5,168,202 | 12/1992 | Bradshaw et al. | 318/608 |
| 5,274,315 | 12/1993 | Finocchi | 318/686 |
| 5,345,160 | 9/1994 | Corniere | 318/811 |
| 5,422,557 | 6/1995 | Lee et al. | 318/807 |
| 5,504,381 | 4/1996 | Kato | 310/51 |

FOREIGN PATENT DOCUMENTS

| | | | |
|---|---|---|---|
| 0 519 878 A1 | 12/1992 | European Pat. Off. | D01G 15/48 |
| 1 685 603 | 8/1971 | Germany | D01G 15/48 |

*Primary Examiner*—Paul Ip
*Attorney, Agent, or Firm*—Wolf, Greenfield & Sacks, P.C.

[57] ABSTRACT

The oscillating mechanical device comprises a shaft on which an oscillating member is mounted, and which is resiliently urged towards a middle angular equilibrium position, together with a single-phase induction motor whose rotor is coupled to the shaft so as to enable oscillations of the shaft to be sustained. According to the invention, the stator of the single-phase induction motor is fed with an alternating drive signal whose frequency is adjusted to the vicinity of the natural frequency of oscillation of the mechanical device. More particularly, the frequency of the drive signal of the stator is set to lie in the frequency range [f–0.8 Hz; f+0.1 Hz], where f represents the natural frequency of oscillation of the mechanical device, and is preferably set to the natural frequency of oscillation of the mechanical device with a tolerance of plus or minus one-tenth of one hertz. The device is applicable to card web combs used in the textile industry.

20 Claims, 6 Drawing Sheets rms CURRENT (A)
12
10
8
6
4
2
0
62
63
63.9
64.7
64.8
65.9
67
68
69
70
FREQUENCY (Hz)

OSCILLATION FREQUENCY (Hz)
AUTOMATIC STARTING
FORCED STARTING
DRIVING FREQUENCY (Hz)
64.7
62.6
62.6
64.7
64.9
65.9

OSCILLATING MECHANICAL DEVICE, IN PARTICULAR A CARD WEB COMB FOR A TEXTILE MACHINE, IN WHICH OSCILLATIONS ARE SUSTAINED BY MEANS OF A SINGLE-PHASE INDUCTION MOTOR

The present invention relates to an oscillating mechanical device whose oscillators are sustained by means of a single phase induction motor. A particular application is in the textile industry in making improved card web combs, which are self-starting and whose amplitude of oscillation can easily be adjusted to large values without risk of overheating the single-phase induction motor.

BACKGROUND OF THE INVENTION

In French patent No. 1 351 572, the Applicant has already proposed an oscillating mechanical device comprising a shaft having an oscillating member mounted thereon and which is urged resiliently towards an angular equilibrium position by means, in particular, of a torsion bar housed inside the shaft. The shaft is coupled to the rotor of a single-phase induction motor. In theory, once the oscillating device has been set into motion, the shaft oscillates with oscillations of given amplitude and at a fixed frequency which is equal to the natural frequency of the mechanical device and which is independent of the frequency of the AC drive signal fed to the stator of the motor. This natural frequency depends in a known manner solely on the torsion characteristics of the resilient return means and on the moment of inertia of the masses subjected to rotary drive, i.e., in particular, the inertia of the shaft, of the member carried by the shaft, and of the rotor. Once the device is oscillating at its natural frequency, the single-phase induction motor serves solely to provide sufficient energy to compensate for damping due to friction, thereby sustaining oscillations.

Such an oscillating device is used more particularly in the textile industry as a simple way of implementing a card web comb for detaching the web at the outlet of a carding machine, and at present the highest possible rate of oscillation is less than 4,000 strokes/minute, which corresponds to a natural frequency of oscillation of about 66.7 Hz. In practice, e.g. with combs oscillating at 2,817 strokes/minute, i.e. combs whose natural frequency of oscillation is 46.95 Hz, the frequency of the AC drive signal fed to the stator of the single-phase induction motor is adjusted to between 53 Hz and 63 Hz. It is known that in this frequency range, the amplitude of comb oscillations is stable and reaches a maximum at a frequency of 54 Hz. Also, in compliance with theory concerning the operation of a card web comb as recalled above, within the range of frequencies and whatever the frequency of the signal fed to the stator, the frequency of oscillation of the comb is constant and equal to the natural frequency of the comb. The oscillations of the comb are thus completely asynchronous relative to the driving frequency applied to the stator of the single-phase induction motor.

A single-phase induction motor is a motor of simple design and it is reliable. When such a motor is used to implement card web combs, it serves advantageously to reduce maintenance costs, compared with using motors that are more sophisticated, e.g. brushless motors.

However, until now, the use of a single-phase induction motor for sustaining oscillations of an oscillating device of the card web comb type has suffered from two main drawbacks.

The first drawback is associated with the fact that a single-phase induction motor draws a large amount of current since its rotor is subjected to frequent reversals in its direction of rotation under the effect of the resilient return action applied to the shaft which is coupled to the rotor. This drawback leads to using an induction motor rated for power that is overdimensioned compared with the rate at which it needs to feed mechanical energy to the comb in order to sustain oscillations.

The second drawback is associated with starting a card web comb that uses a single-phase induction motor. On starting, when the rotor of the single-phase induction motor is stationary and voltage is applied to its stator, the motor develops zero driving torque, so it is necessary to impart a preferred direction of rotation to the rotor in order to start it. When stationary, the single-phase induction motor behaves like a single-phase transformer whose primary and secondary windings carry very high currents. The rotor, and consequently the torsion bar, then begins to vibrate under the effect of intense eddy currents which are induced in the magnetic masses of the motor. In theory, these vibrations serve automatically to start oscillations in the shaft at the natural frequency of oscillation of the mechanical device, and the angular amplitude of the oscillations tends to increase rapidly until it reaches a stable maximum value. In practice, oscillations do not always start. Therefore, to trigger oscillations it is necessary either to start the comb manually by applying torque to the torsion bar, or else to equip the single-phase induction motor with an external starter device.

In order to mitigate the above-specified problems, attempts have been made to replace the single-phase induction motor with a motor that is more sophisticated, e.g. of the brushless motor or DC motor type. That is the solution recommended in European patent EP 519 878 which, in general terms, teaches firstly replacing the single-phase induction motor with a motor that delivers constant torque regardless of the speed of rotation of the rotor, and whose direction of rotation can be reversed under electrical control, and secondly servo-controlling reversal of the direction of rotation as a function of the amplitude of comb oscillation so as to provide an oscillating system. The same solution is adopted in Russian patent application SU 1 227 726.

OBJECT AND SUMMARY OF THE INVENTION

The object of the present invention is to propose an oscillating mechanical device having oscillations that are sustained using a single-phase induction motor, but which mitigates the two above-mentioned drawbacks that have until now been associated with the use of this particular type of asynchronous motor.

According to the invention, the stator of the single-phase induction motor is fed with an alternating drive signal having a frequency adjusted to the vicinity of the natural frequency of oscillation of the mechanical device. Preferably, the frequency of the drive signal fed to the stator is adjusted to the natural frequency of oscillation of the mechanical device within a tolerance of plus or minus one-tenth of one hertz.

Applicant has shown that by feeding the stator of the single-phase induction motor in a narrow frequency range in the vicinity of the natural frequency of oscillation of the mechanical device, i.e. in a range of frequencies that is not the range which has been considered optimal until now, firstly there is a drop in the current drawn by the single-phase induction motor, and secondly the oscillating mechanical device is always self-starting.

Additional tests concerning the frequency behavior of such an oscillating device have also shown that in the vicinity of its natural frequency, the oscillations of the shaft are not asynchronous as they are with the normally-used frequency range, but on the contrary they are synchronous with the frequency of the drive signal fed to the stator of the single-phase induction motor. More precisely, in the frequency range of the invention, the frequency of oscillations of the shaft, and consequently of the rotor of the single-phase induction motor, is equal to the frequency fed to the stator of the single-phase induction motor. The Applicant is unable, at present, to explain why, in the frequency range of the invention, oscillation of the shaft and thus of the rotor is synchronous with the frequency fed to the stator of the single-phase induction motor, whereas in the usual frequency range the oscillation is completely asynchronous, nor why, in the frequency range of the invention, the device is always self-starting.

The natural frequency of oscillation of the oscillating mechanical device depends on the inertia of the masses to which rotary drive is applied and on the torsion characteristics of the resilient return means. This natural frequency of oscillation varies from one device to another. Thus, to implement the invention, it is necessary to qualify each device by accurately determining its natural frequency of oscillation. In order to perform this qualification automatically, the device of the invention is preferably fitted with an electronic control system for the single-phase induction motor whose output delivers an alternating drive signal for feeding to the stator of the single-phase induction motor at a frequency which is adjustable to a determined value. In a first variant embodiment, the electronic control system includes an input sensor measuring the root mean square (rms) value of the current fed to the stator of the single-phase induction motor and is designed, prior to starting the device, to perform frequency scanning over a predetermined range of frequencies which is selected to be broad enough to contain the natural frequency of the electro-mechanical oscillating device, to acquire and store the rms current drawn by the stator of the single-phase induction motor as a function of the frequency fed to said stator, and after frequency scanning has been completed, to set the frequency of the signal fed to the stator at the frequency value corresponding to the minimum rms current measured during frequency scanning.

The Applicant has also shown that for a given voltage of the signal fed to the stator of the single-phase induction motor in the frequency range of the invention, the amplitude of the oscillations passes through a maximum. Consequently, on the basis of the above observation, in a second variant embodiment, the electronic system includes an input sensor that measures the amplitude of oscillations of the shaft of the device, and after frequency scanning has been completed, it sets the frequency of the signal to be fed to the stator to the frequency value which corresponds to the maximum amplitude of oscillation measured during frequency scanning.

BRIEF DESCRIPTION OF THE DRAWINGS

Other characteristics and advantages of the invention appear from the following description of a particular embodiment of a card web comb of the invention, given by way of non-limiting example and described with reference to the accompanying drawings, in which.

MORE DETAILED DESCRIPTION

Figure 1:
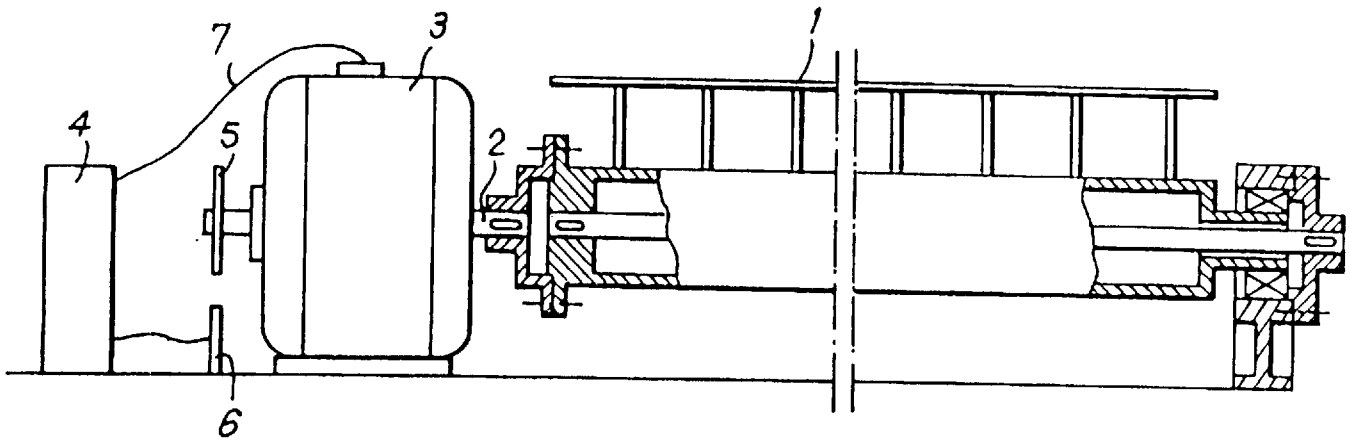
FIG. 1 is a diagram of a card web comb of the invention together with its single-phase induction motor.

The card web comb shown in FIG. 1 comprises a comb proper 1 which is mounted on a shaft 2 that is tubular and secured at one of its ends to the rotor of a single-phase induction motor 3. The shaft 2 contains a coaxial torsion bar providing resilient return of said shaft and the comb 1 towards a central angular equilibrium position. The stator of the single-phase induction motor 3 is fed with an oscillating signal 7 delivered by an electronic control system 4.

According to the invention, the electronic control system 4 delivers an alternating signal 7 of adjustable frequency adjusted to the vicinity of the natural frequency of oscillation of the comb. The reason for making this particular choice will be better understood on inspecting the experimental curves of FIGS. 2 to 4 which are described below and which were obtained using a comb 1 designed to oscillate at about 3,890 strokes/minute.

Figure 2:
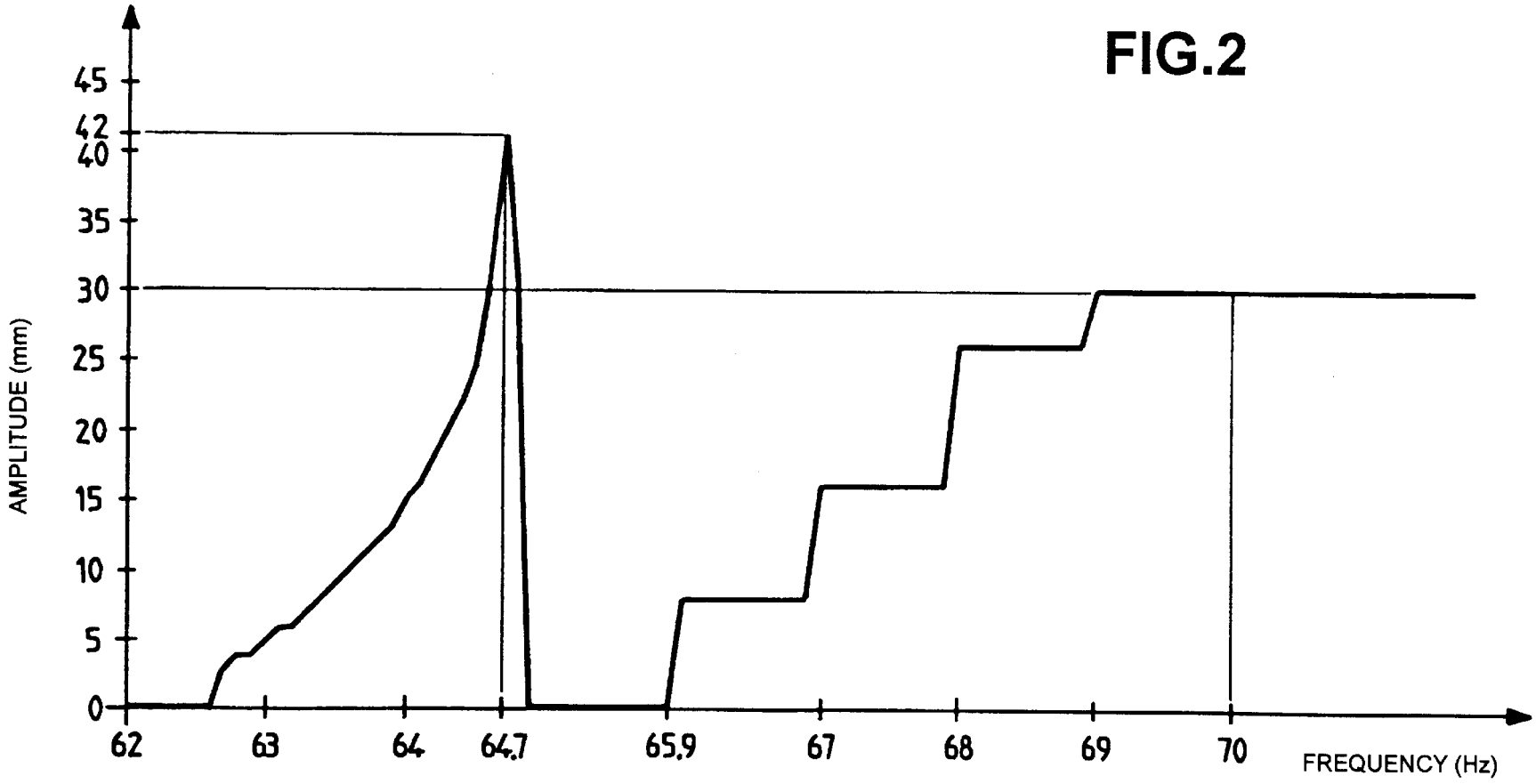
FIGS. 2 to 4 are experimental curves showing the technical characteristics of the FIG. 1 single-phase induction motor when various frequencies are fed to its stator.

The curve of FIG. 2 shows the amplitude of the oscillations of the comb as a function of the frequency of the drive signal 7 fed to the motor 3, with measurements being performed at a given value for the rms voltage of the signal. This curve shows that for frequencies greater than 70 Hz, the amplitude of oscillations of the comb 1 is substantially constant, and of the order of 30 mm.

Until now, the stator of a single-phase induction motor for such a card web comb has always been driven in the above frequency range, since it is known that in said particular range, firstly the amplitude of the oscillations is stable, varying very little as a function of the frequency fed to the stator, and secondly the comb oscillates at a frequency which is fixed and independent of the frequency fed to the stator, which frequency is referred to as the natural frequency of the comb.

It was already known that for frequencies below 70 Hz, oscillations are obtained that are of very unstable amplitude as a function of the driving frequency fed to the stator. That is why it has always been the practice until now to avoid frequencies of less than 70 Hz for a comb designed to oscillate at about 3,890 strokes/minute, and so far as the Applicant is aware, the behavior of a card web comb has not been studied in this range of frequencies. As can be seen from the curve of FIG. 2, for frequencies of less than 70 Hz, there exists a very narrow frequency range 64.6 Hz to 64.8 Hz over which the amplitude of the oscillations is greater than 30 mm, passing through a maximum of about 42 mm at the particular frequency of 64.7 Hz.

Figure 3:
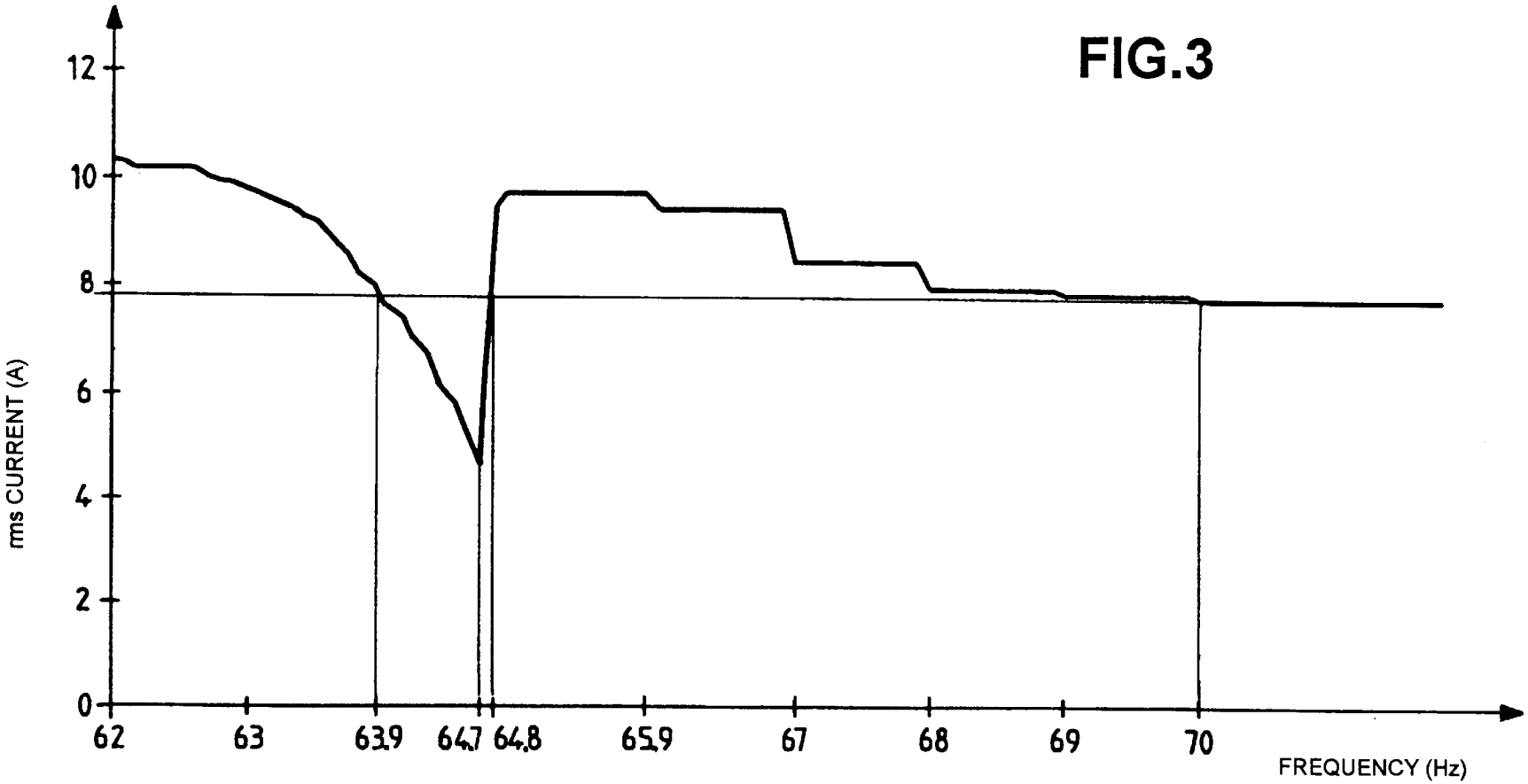

FIG. 3 shows the rms value of the current drawn by the motor 3 as a function of the frequency of the drive signal 7 fed thereto. This curve shows that in the vicinity of the particular frequency of 64.7 Hz, the current drawn drops sharply to about 4.4 A, whereas it is close to 8 A in the usually recommended frequency range, i.e. frequencies greater than 70 Hz.

Figure 4:
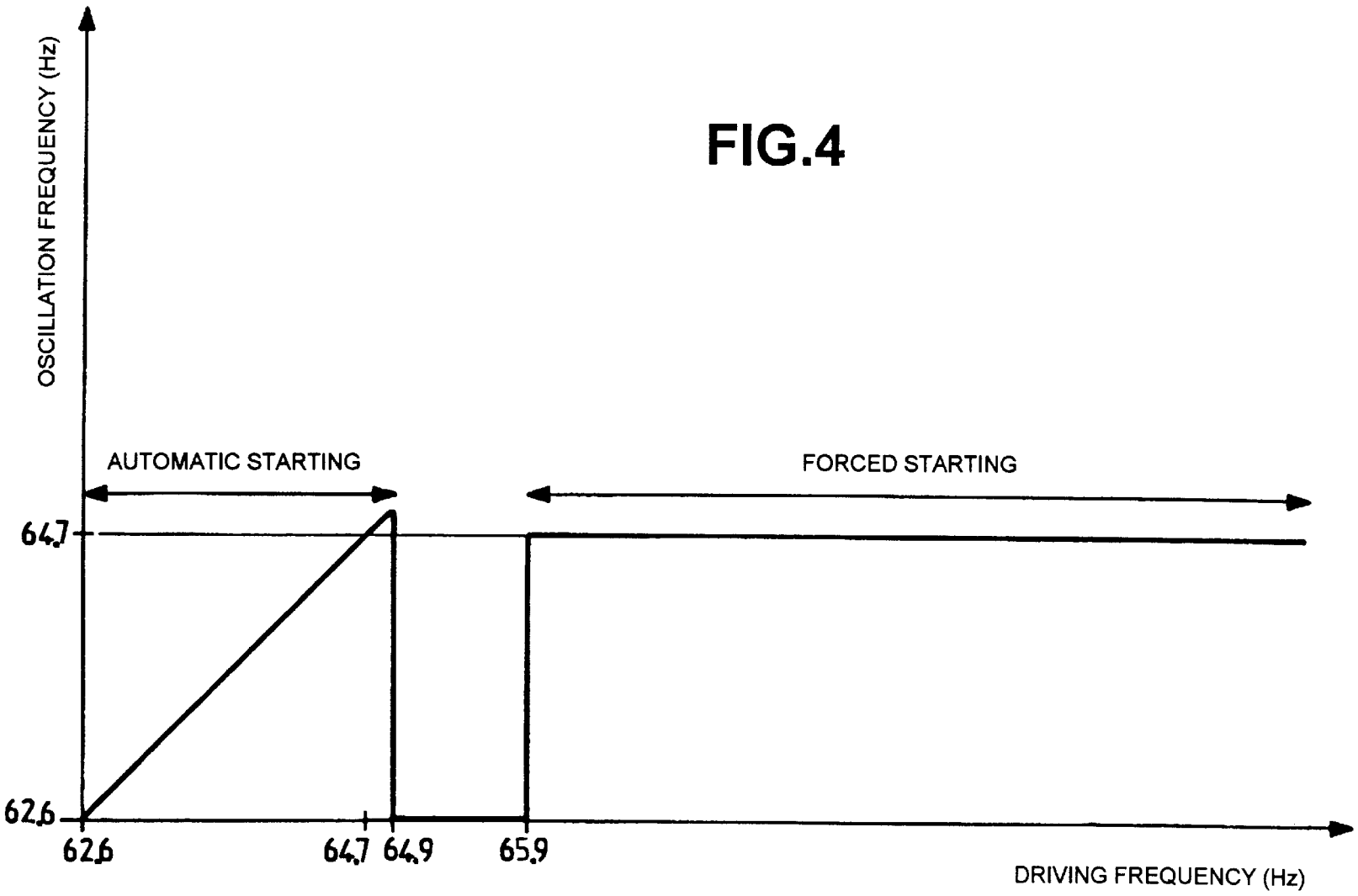

FIG. 4 shows the frequency of oscillation of the shaft 2 of the comb as a function of the frequency of the drive signal 7 fed to the motor. This curve shows that for frequencies greater than 65.9 Hz, the comb oscillates at a natural frequency of 64.7 Hz, which corresponds to a comb oscillating very specifically at 3,882 strokes/minute. The particular frequency of the drive signal 7 at which the rms value of the current drawn by the single-phase induction motor is at a minimum (FIG. 3) and for which the amplitude of oscillation is at a maximum (FIG. 2) thus corresponds to the natural frequency of oscillation of the card web comb.

FIG. 4 also shows, unexpectedly, that for frequencies in the range 62.6 Hz to 64.9 Hz, comb oscillation is not asynchronous as might have been expected, but on the contrary it is synchronous with the frequency of the drive signal 7 fed to the stator of the single-phase induction motor. Also, in this range of frequencies, the comb is always self-starting. When the frequency of the drive signal 7 lies in the range 64.9 Hz to 65.9 Hz, it is not possible to make the comb oscillate. For frequencies greater than 65.9 Hz it is necessary to force the comb in order to start it, e.g. by manually applying torque to the shaft of the comb.

It can clearly be seen from the above analysis of the curves of FIGS. 3 and 4 that for a frequency of the drive signal 7 adjusted to the vicinity of the natural frequency of the comb, i.e. in a narrow range of frequencies lying outside the range of frequencies that has been recommended until now, the comb has the advantage of being self-starting, and of drawing current at a smaller rms value. According to the invention, the concept of a frequency being in the "vicinity" of the natural frequency of a given card web comb is defined by the range of frequencies of the drive signal 7 fed to the stator of the single-phase induction motor for which the rms value of the current drawn by the motor is less than the rms current drawn when the frequency is in the range of frequencies that has hitherto been recommended. In the particular example given, and with reference to FIG. 3, it can be seen that the vicinity of the natural frequency of the comb (64.7 Hz) is constituted by the frequency range 63.9 Hz to 64.8 Hz, i.e. a frequency range of [f−0.8 Hz; f+0.1 Hz], where f is the natural frequency of oscillation of the comb. The invention is nevertheless not limited to this particular frequency range. It is the responsibility of the person skilled in the art to determine for any given comb the exact range of frequencies around the natural frequency of oscillation of the comb for which the rms current drawn by the single-phase induction motor is reduced.

Preferably, the frequency of the drive signal is more particularly adjusted to the natural frequency of the comb with a tolerance of ±0.1 Hz. With reference to FIG. 2, it can be seen that in this frequency range and for a given voltage of the drive signal 7, the amplitude of oscillation is greater than that of the oscillations of the comb when it is driven in its usual asynchronous operating range (frequencies greater than 70 Hz), and the current drawn is smaller. It is thus possible to obtain oscillations of greater amplitude while using a single-phase induction motor of smaller electrical power. Also, for given motor power, it is also possible to adjust the amplitude of comb oscillations over a larger range by varying the voltage fed to the stator. Advantageously, adjusting said amplitude makes it possible to adapt the card web comb to any existing type of fiber web coming from the carding machine on which the comb is mounted. If the fiber web presents a high level of opposing torque, then the amplitude of the oscillations is adjusted so as to obtain sufficient driving torque to minimize the number of times the comb becomes clogged in operation.

Finally, the drop in the current drawn by the single-phase induction motor in the narrow frequency range of the invention makes it possible to envisage providing card web combs that have higher natural frequencies of oscillation, thereby increasing the throughput of the carding machines to which they are fitted. The current drawn by the motor increases with increasing natural frequency of oscillation of the comb, regardless of the frequency at which the motor is driven. In the frequency range that has hitherto been recommended, combs have been restricted to a natural frequency of oscillation of less than 4,000 strokes/minute because of excessive current consumption. When the stator is driven in the frequency range of the invention, it becomes possible to provide combs that oscillate at frequencies greater than 4,000 strokes/minute without running the risk of over-heating the single-phase induction motor. Further, given that the electrical power consumed by the motor is reduced by the invention, it becomes possible to use lower power single-phase induction motors, i.e. induction motors that are smaller in size and whose rotors present lower inertia, thereby making it possible to envisage making combs having a higher natural frequency of oscillation.

Figure 5:
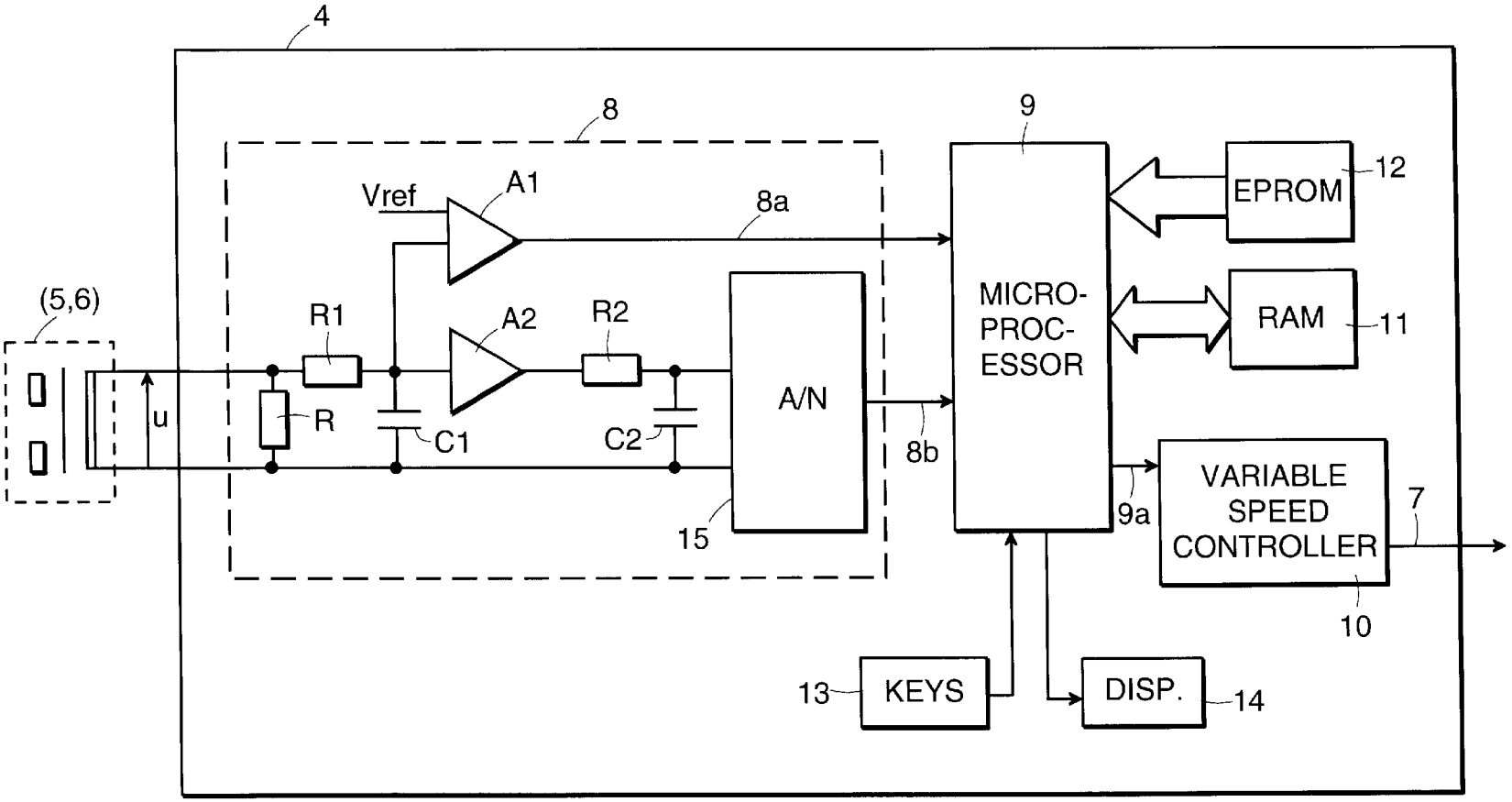
FIG. 5 is a general block diagram of the electronic system for controlling the FIG. 1 single-phase induction motor.

A preferred embodiment of the electronic control system 4 of the invention is shown in FIG. 5 and is described below. In this embodiment the electronic control system 4 comprises an electronic circuit 8, a microprocessor 9, and a variable-speed controller 10 which delivers the drive signal 7 fed to the stator of the single-phase induction motor. In known manner, the microprocessor 9 co-operates with a read-only memory 12 of the EPROM type containing the program for running the microprocessor, a random-access memory 11, a keypad 13, and a display 14. The frequency of the alternating drive signal 7 delivered by the variable speed controller 10 is set by the microprocessor 9 by means of a control signal 9*a*. The card web comb is also fitted with a sensor 5, 6 which measures the amplitude of oscillation of the shaft 2 and delivers to the electronic circuit 8 a varying voltage U whose instantaneous value is a function of the angle of rotation of the shaft 2. In a particular embodiment, the sensor was a magnetic Hall effect sensor. It could equally well be a strain gauge mounted directly on the surface of the shaft 2, or any other sensor known to the person skilled in the art and performing the same function.

The function of the electronic circuit 8 is to transform the varying voltage U delivered by the amplitude sensor 5, 6 into an analog first signal 8*a* representative of the frequency of oscillation of the shaft 2, and into a digital second signal 8*b* whose value is a function of the amplitude of the oscillations of the shaft 2. To this end, in the particular embodiment shown in FIG. 5, the electronic circuit 8 has an input voltage/current converter constituted by a resistor R, and a first RC filter constituted by a resistor R1 and a capacitor C1. A first operational amplifier A1 connected as a comparator receives a reference voltage Vref on one input and the output signal from the above-mentioned first RC filter on another input, and it delivers the analog signal 8*a* for the microprocessor 9. When the card web comb is oscillating, the signal 8*a* is constituted by a pulse train at a frequency which is a direct function of the real frequency of oscillation of the shaft 2. The output signal from the first RC filter is also amplified by means of a second operational amplifier A2, and is filtered by a second RC filter constituted by a resistor R2 and a capacitor C2. The voltage across the terminals of the capacitor C2 corresponds to the mean value of the varying voltage U delivered by the sensor 5, 6, and is therefore proportional to the amplitude of the oscillations of the shaft 2. This voltage is converted by means of an analog-to-digital converter 15 which delivers the above-mentioned digital signal 8*b* to the microprocessor 9.

The microprocessor 9 is capable of using the two signals 8*a* and 8*b* to acquire at any given instant the frequency and the amplitude of the oscillations of the shaft 2 of the card web comb. The operation of the microprocessor is described in detail below with reference to the flow chart of FIG. 6.

Once the microprocessor 9 has been initialized, it performs a key-scan loop waiting for an operator to input (step 16) a minimum frequency (Fmin) and a maximum frequency (Fmax). These two frequencies correspond to lower and upper limits for a range of frequencies which is selected to be broad enough to be certain to contain the natural frequency of oscillation of the comb. For the comb whose operating curves are given in FIGS. 2 to 4, Fmin may be fixed at 60 Hz and Fmax at 70 Hz, for example. Once the frequencies have been input, the microprocessor 9 controls the variable speed controller 10 iteratively by means of the control signal 9*a* so as to cause the controller 10 to deliver a drive signal 7 at a frequency which varies in discontinuous manner, with a predetermined frequency increment (dF) over the entire frequency range (Fmin, Fmax). This frequency increment (dF) may be fixed permanently, or it may optionally be input together with the limits on the frequency range (Fmin, Fmax). For each frequency of the drive signal, the microprocessor acquires and stores in RAM 11 the frequency and the amplitude of the oscillations of the comb by making use of the signals 8*a* and 8*b*, respectively. This operation of the microprocessor is illustrated by steps 17 to 22 in the flow chart of FIG. 6. Once this first acquisition cycle has been completed, i.e. once the microprocessor has scanned the entire frequency range (Fmin, Fmax), the RAM 11 contains a table in the form of pairs of acquired values (amplitude, frequency). On the basis of this table, the microprocessor determines the frequency $F_0$ which corresponds to the maximum amplitude acquired (step 23), sets the variable speed controller 10 so that it delivers a drive signal 7 at the frequency $F_0$ (step 24), and displays this frequency on the display 14 for the operator (step 25).

The frequency value $F_0$ as calculated by the microprocessor corresponds to the natural frequency of the comb with tolerance that depends on the value of the frequency increment dF. More precisely, in the worst case, the value of $F_0$ will differ from the real natural frequency of the comb by an amount not exceeding 50% of dF. Consequently, to obtain a frequency $F_0$ which is equal to the natural frequency of the comb with a tolerance of ±0.1 Hz, the maximum value of the frequency increment dF must be 0.2 Hz.

In another embodiment of the electronic control system 4, the system is designed to determine the natural frequency of oscillation of the card web comb automatically, not from a measure of the amplitude of comb oscillation, but from a measure of the rms current drawn by the single-phase induction motor 3. This variant embodiment is not described in detail since the person skilled in the art can deduce it easily from the embodiment described with reference to FIGS. 5 and 6. It suffices to replace the sensor 5, 6 which measures the amplitude of the oscillations by a sensor which measures the rms value of the drive signal 7, and to modify step 23 of the flow chart of FIG. 6 so as to calculate the frequency $F_0$ as being the frequency which corresponds to the minimum acquired rms current, instead of the maximum acquired amplitude of oscillation.

Figure 6:
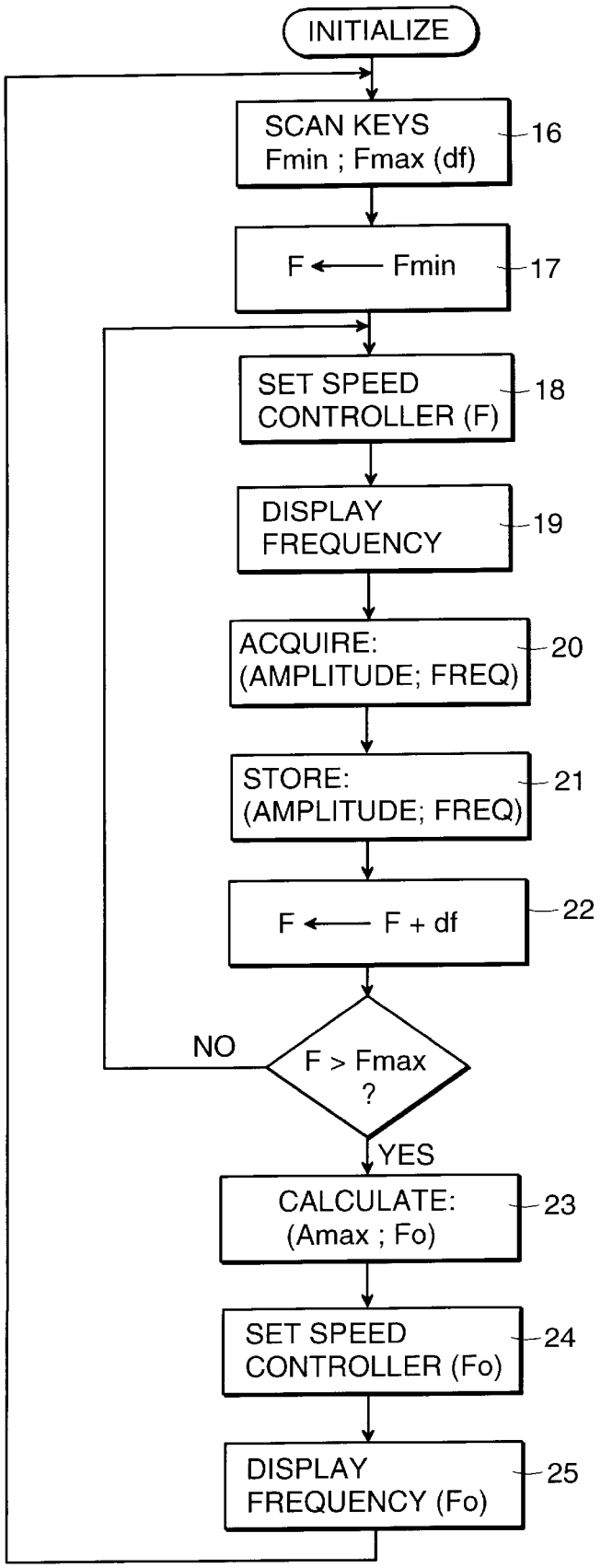
FIG. 6 is a flow chart of the operation of the microprocessor in the FIG. 5 electronic control system.

The invention is not limited to the particular flow chart shown in FIG. 6. For example, it is possible to eliminate step 21 in which all pairs of values acquired by the microprocessor in step 20 are stored, i.e. pairs of values comprising a frequency associated either with an amplitude or with a current depending on the particular variant of the electronic control system. Step 21 is then replaced by a step of storing the amplitude (or current) acquired at a given instant, providing said amplitude (or current) is greater (or less) than a previously acquired and stored amplitude (or current).

The invention is not limited to implementing card web combs for textile machinery, but may be applied more generally to any electro-mechanical oscillating device in which oscillations are sustained by means of a single-phase induction motor.

We claim:

1. An electro-mechanical oscillating device, comprising:

a shaft;

an oscillating member mounted on said shaft and urged resiliently towards a middle angular equilibrium position;

a single-phase induction motor having a rotor coupled to the shaft so as to enable oscillations of the shaft to be sustained; and a control system for delivering to the stator of the single-phase induction motor an alternating drive signal having a frequency adjusted to a vicinity of a natural frequency of oscillation of the electro-mechanical oscillating device.

2. A device according to claim 1, wherein the frequency of the drive signal delivered by the control system is adjusted such that f−0.8 Hz<the frequency of the drive signal<f+0.1 Hz, where f represents the natural frequency of oscillation of the electro-mechanical oscillating device.

3. A device according claim 2, wherein the frequency of the drive signal delivered by the control system is adjusted to the natural frequency of oscillation of the electro-mechanical oscillating device with a tolerance of plus or minus one-tenth of one hertz.

4. A device according the claim 1, further comprising:

a sensor connected to the control system to measure the rms value of the current fed to the stator of the single-phase induction motor; and wherein the control system is also designed, prior to starting the device, to perform a frequency scan by adjusting the frequency of the alternating drive signal through a predetermined range of frequencies selected to be broad enough to contain the natural frequency of oscillation of the electro-mechanical oscillating device, to acquire the rms value of the current drawn by the stator of the single-phase induction motor as a function of the driving frequency fed to said stator, and after the frequency scan has been completed, to set the frequency of the drive signal of the stator to the frequency which corresponds to a minimum rms current value acquired during the scan.

5. A device according to claim 4, wherein the control system is designed to perform a discontinuous frequency scan with a frequency increment equal to not more than 0.2 Hz.

6. A device according to claim 1, further comprising:

a sensor connected to the control system to measure an amplitude of oscillations of the shaft of the device; and wherein the control system is designed, prior to starting the device, to perform a frequency scan by adjusting the frequency of the alternating drive signal over a predetermined range of frequencies which is selected to be broad enough to contain the natural frequency of oscillation of the electro-mechanical oscillating device, to acquire the value of the amplitude of the oscillations as a function of the driving frequency of the stator of the single-phase induction motor, and when the frequency scan is complete, to set the frequency of the drive signal of the stator to a frequency which corresponds to a maximum oscillation amplitude acquired during the scan.

7. A device according to claim 6, wherein the control system is designed to perform a discontinuous frequency scan with a frequency increment equal to not more than 0.2 Hz.

8. A device according to claim 1 wherein the single-phase induction motor is an asynchronous motor.

9. A card web comb for a textile machine, comprising:

a shaft;

an oscillating member mounted on said shaft and urged resiliently towards a middle angular equilibrium position;

a single-phase induction motor having a rotor coupled to the shaft so as to enable oscillations of the shaft to be sustained; and a control system for delivering to the stator of the single-phase induction motor an alternating drive signal having a frequency adjusted to a vicinity of a natural frequency of oscillation of the card web comb.

10. A card web comb for a textile machine according to claim 9, wherein the frequency of the drive signal delivered by the control system is adjusted such that f−0.8 Hz<the frequency of the drive signal<f+0.1 Hz, where f represents the natural frequency of oscillation of the card web comb.

11. A card web comb for a textile machine according to claim 10, wherein the frequency of the drive signal delivered by the control system is adjusted to the natural frequency of oscillation of the card web comb with a tolerance of plus or minus one-tenth of one hertz.

12. A card web comb for a textile machine according the claim 9, further comprising:

a sensor connected to the control system to measure the rms value of the current fed to the stator of the single-phase induction motor; and wherein the control system is also designed, prior to starting the card web comb, to perform a frequency scan by adjusting the frequency of the alternating drive signal through a predetermined range of frequencies selected to be broad enough to contain the natural frequency of oscillation of the card web comb, to acquire the rms value of the current drawn by the stator of the single-phase induction motor as a function of the driving frequency fed to said stator, and after the frequency scan has been completed, to set the frequency of the drive signal of the stator to the frequency which corresponds to a minimum rms current value acquired during the scan.

13. A card web comb for a textile machine according to claim 12, wherein the control system is designed to perform a discontinuous frequency scan with a frequency increment equal to not more than 0.2 Hz.

14. A card web comb for a textile machine according to claim 9, further comprising:

a sensor connected to the control system to measure an amplitude of oscillations of the shaft of the card web comb; and wherein the control system is designed, prior to starting the card web comb, to perform a frequency scan by adjusting the frequency of the alternating drive signal over a predetermined range of frequencies which is selected to be broad enough to contain the natural frequency of oscillation of the card web comb, to acquire the value of the amplitude of the oscillations as a function of the driving frequency of the stator of the single-phase induction motor, and when the frequency scan is complete, to set the frequency of the drive signal of the stator to a frequency which corresponds to a maximum oscillation amplitude acquired during the scan.

15. A card web comb for a textile machine according to claim 14 wherein the control system is designed to perform a discontinuous frequency scan with a frequency increment equal to not more than 0.2 Hz.

16. A device according to claim 9, wherein the single-phase induction motor is an asynchronous motor.

17. A method of controlling a card web comb for a textile machine, comprising:

delivering to a single-phase induction motor of the card web comb an alternating drive signal to enable oscillations of a shaft coupled to a rotor of the single-phase induction motor to be sustained; and controlling a frequency of the alternating drive signal to thereby cause the frequency of the alternating drive signal to be adjusted to a vicinity of a natural frequency of oscillation of the card web comb.

18. The method of claim 17, wherein the frequency of the alternating drive signal is adjusted to the natural frequency of oscillation of the card web comb with a tolerance of plus or minus one-tenth of one hertz.

19. The method of claim 17, further comprising:

sensing the rms value of the current fed to the stator of the single-phase induction motor; and prior to starting the web comb, performing a frequency scan by adjusting the frequency of the alternating drive signal through a predetermined range of frequencies selected to be broad enough to contain the natural frequency of oscillation of the card web comb, to acquire the rms value of the current drawn by the stator of the single-phase induction motor as a function of the driving frequency fed to said stator, and after the frequency scan has been completed, to set the frequency of the drive signal of the stator to the frequency which corresponds to a minimum rms current value acquired during the scan.

20. The method of claim 17, further comprising:

sensing an amplitude of oscillation of the shaft of the card web comb; and prior to starting the web comb, performing a frequency scan by adjusting the frequency of the alternating drive signal through a predetermined range of frequencies which is selected to be broad enough to contain the natural frequency of oscillation of the card web comb, to acquire the value of the amplitude of the oscillations as a function of the driving frequency of the stator of the single-phase induction motor, and when the frequency scan is complete, to set the frequency of the drive signal of the stator to a frequency which corresponds to a maximum oscillation amplitude acquired during the scan.

* * * * *